US008256262B2

(12) United States Patent
Matsui

(10) Patent No.: US 8,256,262 B2
(45) Date of Patent: Sep. 4, 2012

(54) METHOD AND APPARATUS FOR BENDING A METAL MEMBER

(75) Inventor: Ken Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 739 days.

(21) Appl. No.: 12/409,922

(22) Filed: Mar. 24, 2009

(65) Prior Publication Data

US 2009/0241630 A1 Oct. 1, 2009

(30) Foreign Application Priority Data

Apr. 1, 2008 (JP) ..... 2008-094535
Jan. 30, 2009 (JP) ..... 2009-020246

(51) Int. Cl.
*B21D 11/20* (2006.01)
*B21D 5/00* (2006.01)
*B21D 22/21* (2006.01)

(52) U.S. Cl. ..... 72/389.1; 72/381; 72/347

(58) Field of Classification Search ..... 72/369, 72/381, 347, 354.6, 352, 323, 469, 350, 386, 72/389.1, 389.2
See application file for complete search history.

(56) References Cited

U.S. PATENT DOCUMENTS 5,901,601 A * 5/1999 Fujimoto et al. ..... 72/389.1
6,722,174 B1 * 4/2004 Nishii et al. ..... 72/41

FOREIGN PATENT DOCUMENTS

JP 3280733 5/2002
JP 2004-74239 3/2004

* cited by examiner

*Primary Examiner* — Debra Sullivan
(74) *Attorney, Agent, or Firm* — Fitzpatrick, Cella, Harper & Scinto

(57) ABSTRACT

A bending apparatus for bending a metal member includes at least one die, a punch disposed on an opposite side of the die through the metal member for pressurizing the metal member by relatively moving with respect to the die to perform bending, and a knock out die for supporting the metal member when the bending is performed. Friction generated on a surface of the knock out die for receiving the metal member becomes smaller continuously or gradually from a center portion toward side portions thereof in a bending ridge line direction. In addition, a surface of the knock out die includes multiple grooves formed at the side portions thereof in the bending ridge line direction, and widths of the multiple grooves become larger continuously or gradually from the center portion toward the side portions of the knock out die in the bending ridge line direction.

18 Claims, 11 Drawing Sheets

METHOD AND APPARATUS FOR BENDING A METAL MEMBER

BACKGROUND OF THE INVENTION

1. Field of the Invention

The present invention relates to a method and apparatus for bending a sheet metal member through application of pressure thereon.

2. Description of the Related Art

Conventionally, components obtained by bending a sheet metal member have been used in various fields such as a rail used in a copying machine, a printer, or the like. FIG. 11A is a cross-sectional view illustrating a generally-used bending apparatus which is in a state before bending is started. FIG. 11A illustrates a sheet metal member (work) W which is to be subjected to bending, and the generally-used bending apparatus including a pair of dies 101*a* and 101*b*, a punch 102, and a knock out die 103. The work W is placed on the pair of dies 101*a* and 101*b* so as to bridge the dies 101*a* and 101*b*. The knock out die 103 is placed between the dies 101*a* and 101*b* below the work W, and the punch 102 is placed at a position at which the punch 102 is opposed to the knock out die 103 through the work W. The knock out die 103 is a member serving as a bracket when the work W is pressurized by the punch 102, and is pressed against the work W from below by a spring member (not shown). As the punch 102 descends (relatively moves) with respect to the dies 101*a* and 101*b* and the work W is bent, the spring member contracts, whereby the knock out die 103 descends. As a result, the work W is bent into a U-shape. FIG. 11B illustrates the work W which is bent into the U-shape.

In general, highly-accurate flatness and straightness in a bending ridge line direction are required for a bending member used in a precision apparatus. However, during the bending, a concave surface (on a punch side) and a convex surface (on a knock out die side) of the work W are applied with a compressive stress and a tensile stress, respectively. Accordingly, the work W cambers in a direction indicated by an arrow A of FIG. 11B due to a residual stress as a result of the bending.

In order to suppress a generation of the camber as described above, Japanese Patent No. 3280733 describes a structure in which a female mold (knock out die) is divided into multiple pieces in a direction parallel to a bending ridge line. With the structure as described above, the respective divided female molds can move in accordance with a frictional force generated between the work W and the female molds during the bending in the direction parallel to the bending ridge line. Accordingly, processing can be performed while releasing a stress generated during the bending in the direction parallel to the bending ridge line, with the result that the camber of the work can be suppressed.

Further, Japanese Patent Application Laid-Open No. 2004-074239 describes a method of forming multiple locally-deformed portions (concave portions) on a female mold (knock out die) side of a work simultaneously with the bending. With the structure as described above, a tensile stress applied on the knock out die side of the work is partially compensated by a compressive stress which is applied through the formation of the locally-deformed portions, to thereby suppress the camber of the work.

In recent years, along with higher speed and higher resolution of a precision apparatus such as a copying machine or a printer, there has been required a rail or the like which has more highly-accurate flatness and straightness. However, in the method described in Japanese Patent No. 3280733, the stress is gradually released by movements of the divided female molds, and thus a stress condition of the work varies considerably for each female mold which moves. Thus, the stress cannot be released continuously. In addition, due to mechanical sliding accompanying the movements of the female molds, variations in amount of camber are increased for each product. Moreover, the structure of the bending apparatus becomes complicated, leading to an increase in cost for an apparatus.

Further, in the method described in Japanese Patent Application Laid-Open No. 2004-074239, the amount of camber of the work can be suppressed, but the stress which is generated due to plastic deformation of the work increases. In addition, the method works locally, and hence a distribution of the stresses along the bending ridge line becomes extremely complicated, which incurs a risk that the work may be undulated or locally deformed by a large amount.

SUMMARY OF THE INVENTION

It is an object of the present invention to provide a bending apparatus and a bending method which are capable of easily and effectively reducing a camber or undulation resulting from a residual stress of a bending member during bending.

According to the present invention, in a bending apparatus and a bending method for bending a metal member, the bending apparatus includes: at least one die; a punch disposed on a side opposed to a side of the at least one die through the metal member, for pressurizing the metal member by relatively moving with respect to the at least one die to perform bending; and a knock out die for supporting the metal member when the bending is performed, and friction generated on a surface of the knock out die for supporting the metal member becomes smaller continuously or gradually from a center portion toward side portions thereof in a bending ridge line direction.

Further features of the present invention become apparent from the following description of exemplary embodiments with reference to the attached drawings.

DESCRIPTION OF THE EMBODIMENTS

In order to suppress a camber of a work through the above-mentioned bending, the inventor of the present invention has analyzed behaviors of the work during the bending by a simulation. Hereinafter, the behaviors of the work during the bending are described, and then the examples of the present invention are described.

Figure 9A:
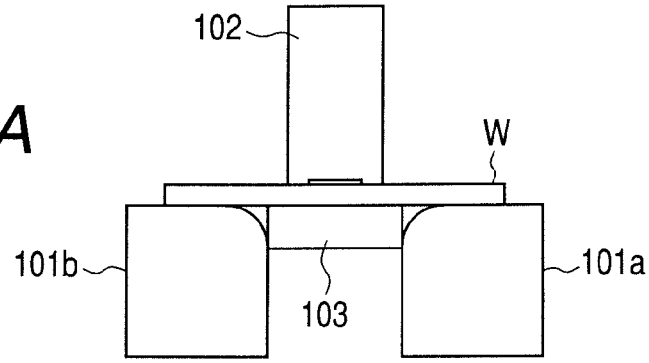
FIGS. 9A, 9B, 9C and 9D are cross-sectional views illustrating a conventional bending method.
Figure 11A:
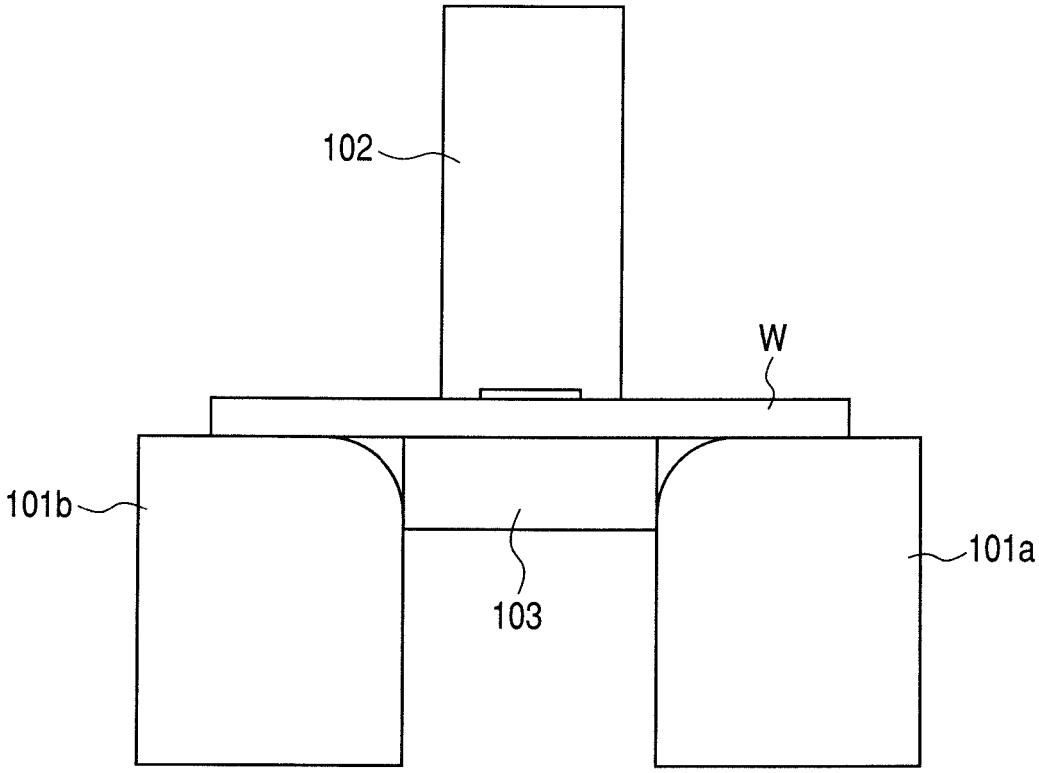
FIGS. 11A and 11B are a cross-sectional view illustrating a conventional bending apparatus and a perspective view illustrating a work subjected to bending, respectively.

First, a phenomenon occurring in a work W through conventional bending is described. FIGS. 9A to 9D are cross-sectional views illustrating respective states of the bending. It should be noted that the same reference symbols as those of FIG. 11A are used in FIG. 9A. FIG. 9A illustrates the state before the same bending as that of FIG. 11A is started.

Figure 9B:
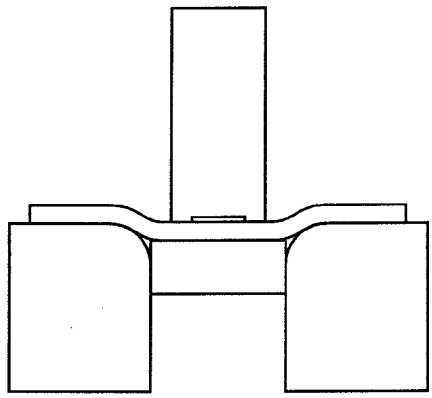
Figure 10:
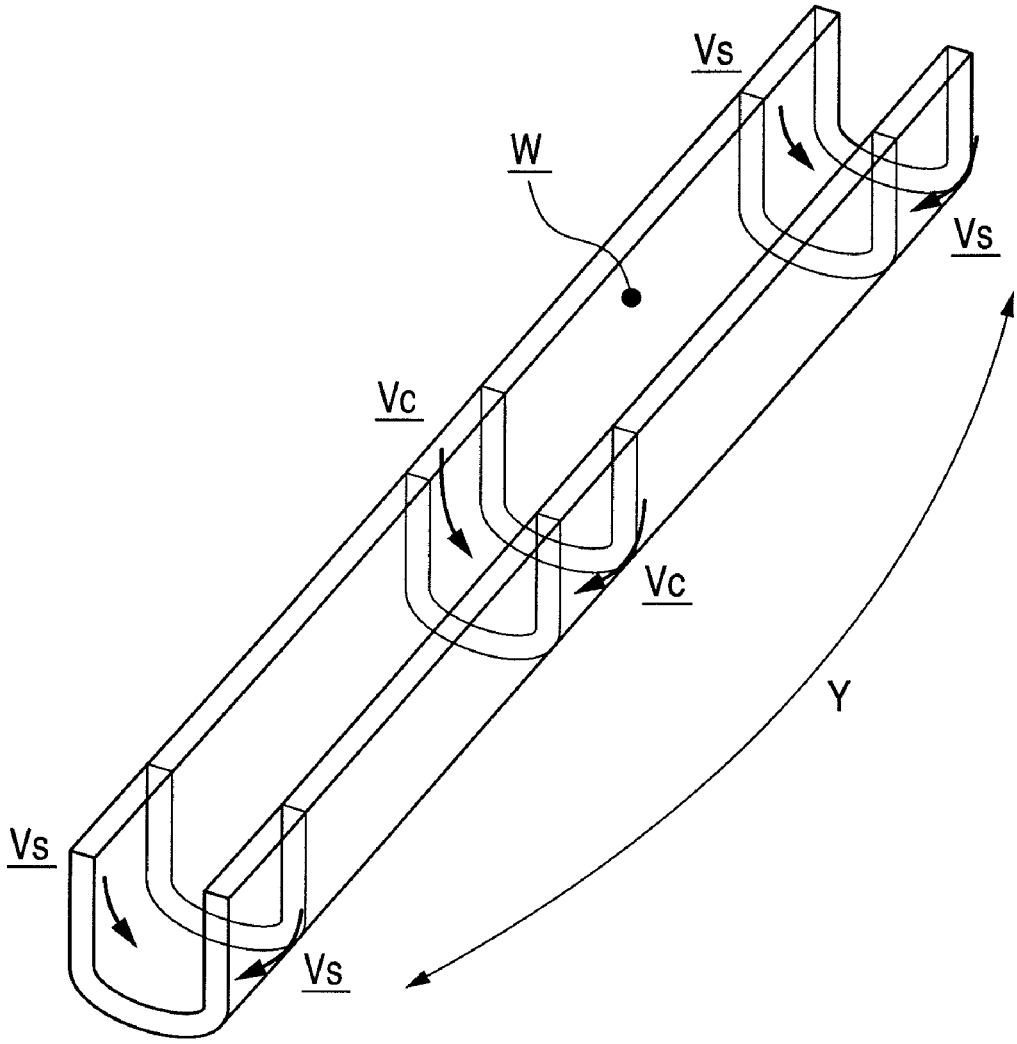
FIG. 10 is a schematic view illustrating a flowing-in amount of a work through the bending.

FIG. 9B is the cross-sectional view illustrating the state at a time when the bending of the work W is started by a punch 102. As described above, a tensile stress and a compressive stress are generated on a convex surface and a concave surface of the work W, respectively, and the stresses are easily released at side portions of the work W in a ridge line direction. In other words, the stresses which are actually applied to the work W are small at the side portions of the work W in the ridge line direction, and increase as closer to a center portion thereof. FIG. 10 is a view illustrating a flowing-in condition due to deformation when the work W is subjected to the bending. In FIG. 10, a flowing-in amount Vs at the side portions of the work W in the ridge direction, in which the stresses are released, is relatively small, whereas a flowing-in amount Vc at a center portion of the work W in the ridge direction, in which the stresses are not released, is relatively large. Accordingly, as indicated by an arrow Y of FIG. 10, the work W cambers so that the center portion of the bending ridge line becomes a convex portion.

Figure 9C:
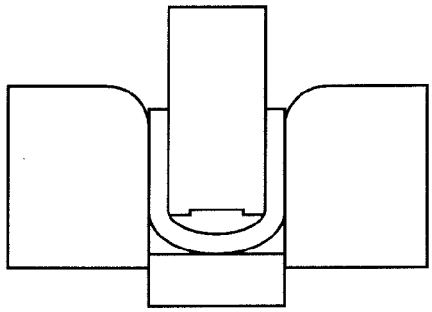

Next, FIG. 9C is the cross-sectional view illustrating the state at a time when the punch 102 is caused to descend further and the bending is advanced. As illustrated in FIG. 9C, as the punch 102 is pressed down, a gap is generated between the work W and an undersurface of the punch 102. The gap becomes larger as closer to the center portion of the work W, which is illustrated in the cross-sectional view of FIG. 9C. Further, at this time, the work W keeps a state of cambering in the bending ridge line direction illustrated in FIG. 9B. That is, in the state of FIG. 9C, the work W and a knock out die 103 are brought into contact with each other only in the vicinity of a portion which is the center portion of the work in the cross-section of FIG. 9C and also is the center portion in the bending ridge line direction.

Figure 9D:
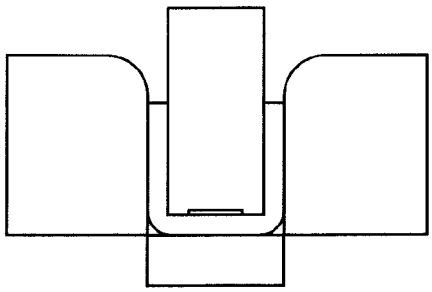
Figure 11B:
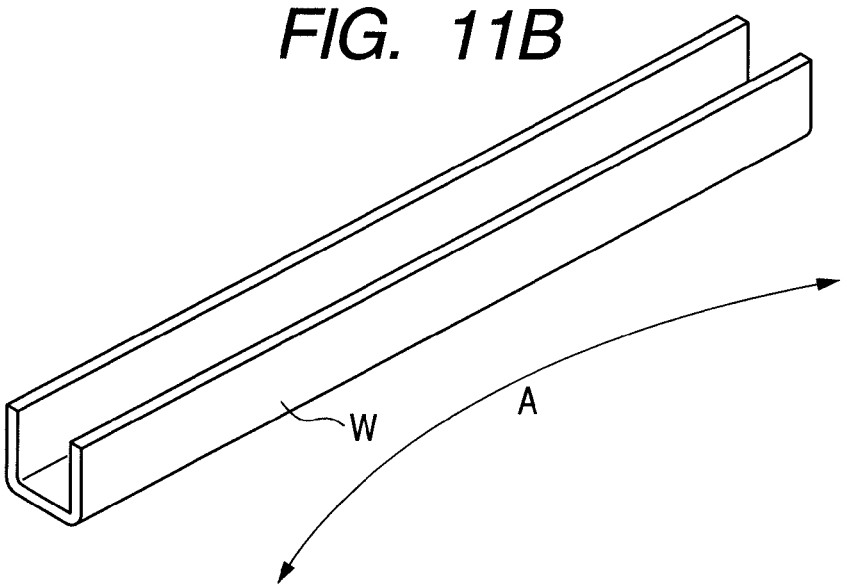

Next, FIG. 9D is the cross-sectional view illustrating the state at a time when the punch 102 is caused to descend further, and the bending is advanced and then is stopped. When the state shifts from FIG. 9C to FIG. 9D, the contact between the work W and the knock out die 103 is gradually expanded from the center portion in the cross-section of FIG. 9C toward the bending ridge line direction. At the same time, the contact therebetween is also expanded from the center portion toward the side portions of the work W in the bending ridge line direction. More specifically, the flowing-in of the material due to bending deformation is advanced in such a manner that the flowing-in amount Vc at the center portion of the work W in the ridge line direction, in which deformation is started earlier, becomes large to some extent, and then the side portions of the work W in the ridge line direction are deformed behind the deformation occurring at the center portion by an amount in which the work W cambers in the Y direction, whereby the flowing-in amount Vs starts to increase. That is, excessive stresses are generated at the side portions of the work W in the ridge line direction when the bending is finished. As a result, when the work W is released from the excessive stresses the work W cambers in the above-mentioned direction indicated by the arrow A of FIG. 11B. The work W not only cambers but also undulates greatly.

EXAMPLE 1

Figure 1A:
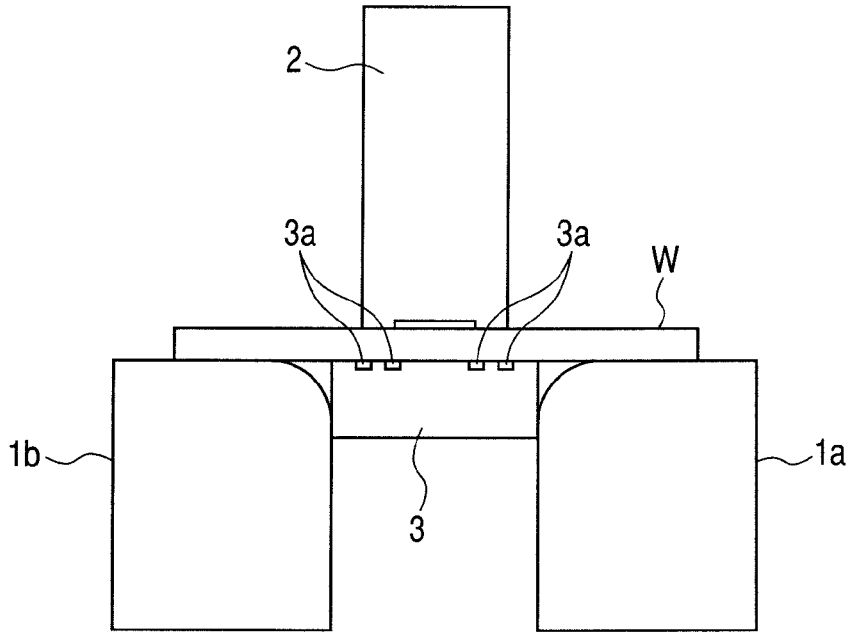
FIGS. 1A and 1B are a cross-sectional view illustrating a bending apparatus and a perspective view illustrating a knock out die according to Example 1 of the present invention, respectively.

FIG. 1A is a cross-sectional view illustrating a bending apparatus according to the present invention, which is in a state before the bending is started. In FIG. 1A, the bending apparatus includes a sheet metal member (work) W to be subjected to bending, a pair of dies 1*a* and 1*b*, a punch 2, and a knock out die 3. The work W is placed on the pair of dies 1*a* and 1*b* so as to bridge the dies 1*a* and 1*b*. The knock out die 3 is placed between the dies 1*a* and 1*b* below the work W, and the punch 2 is placed at a position so as to face the knock out die 3 through the work W. The knock out die 3 is a member serving as a bracket when the work W is pressurized by the punch 2, and is pressed against the work W by a spring member (not shown) from below. As the punch 2 descends and the work W is bent, the spring member contracts, whereby the knock out die 3 descends.

Figure 1B:
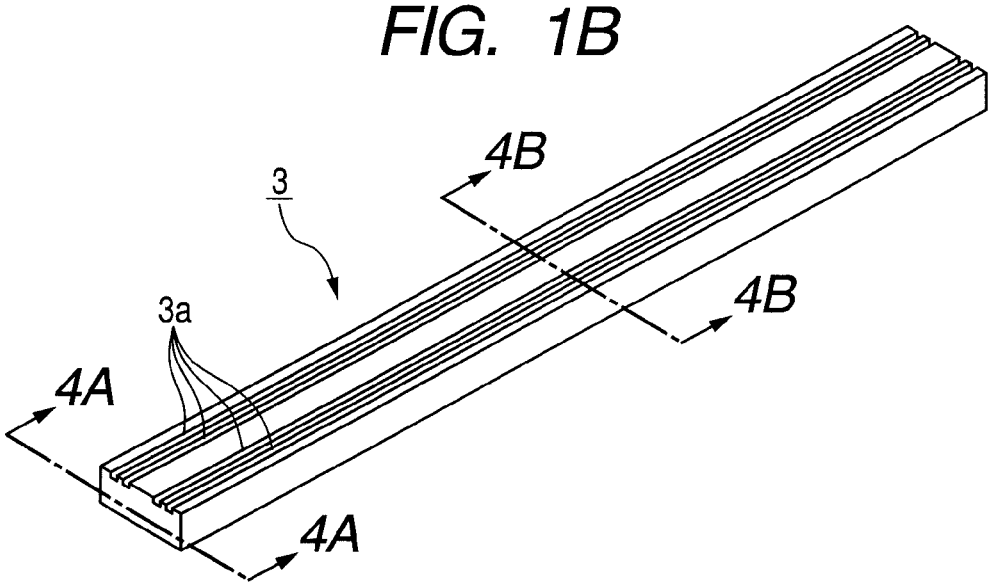

FIG. 1B is a perspective view illustrating the knock out die 3. On a surface of the knock out die 3, which is to be brought into contact with the work W, in order to reduce friction between the work W and the knock out die 3, multiple grooves 3*a* which are friction-reducing-regions extending along the bending ridge line are formed. In this case, four grooves 3*a* are formed, and a width of each thereof becomes gradually smaller as closer to the center portion from the side portions of the knock out die 3.

A phenomenon occurring in the work W in the bending with the use of the knock out die 3 according to Example 1 is described. FIGS. 2A to 2D are cross-sectional views illustrating respective states of the bending. It should be noted that the same components as those of FIG. 1A are denoted by the same reference symbols.

Figure 2A:
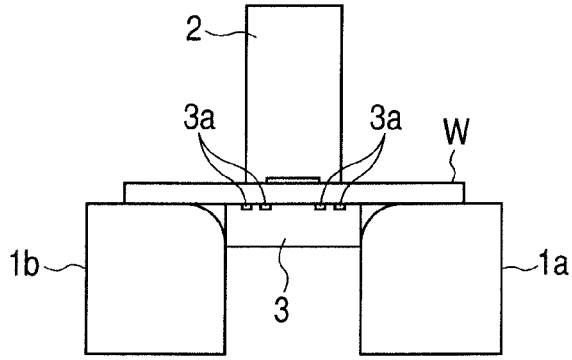
FIGS. 2A, 2B, 2C and 2D are cross-sectional views illustrating a bending method according to Example 1.

FIG. 2A illustrates the state before the bending is started.

Figure 2B:
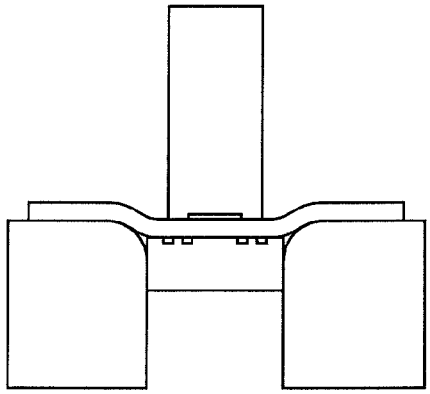

Next, FIG. 2B is the cross-sectional view illustrating the state at the time when the bending of the work W is started by the punch 2. It should be noted that the state of flowing-in of the material due to deformation at the time when the work W is subjected to the bending is described with reference to FIG. 10. As in the case of FIG. 9B described above, the stresses applied to the work W are small in the side portions of the work W in the ridge line direction, and become larger as closer to the center portion thereof. However, friction between the work W and the knock out die 3 is reduced by means of the grooves 3*a* provided in the knock out die 3. As a result, a flowing-in amount of the material in the work W increases. However, the width of the groove 3*a* located at the center portion of the work W in the ridge line direction is small, and hence there is no large difference in flowing-in amount between the case of FIG. 2B and the case of FIG. 9B. On the contrary, the widths of the grooves 3*a* located at the side portions of the work W in the ridge line direction are large, and hence the friction between the work W and the knock out die 3 is considerably reduced. Accordingly, the flowing-in amounts Vs of the material at the side portions of the work W in the ridge line direction increase by a large amount. In other words, compared with the case of FIG. 9B, difference in flowing-in amount of the material in the ridge line direction of the work W is reduced, and the camber of the work W, in which the center portion thereof in the ridge line direction becomes the convex portion, is considerably reduced.

Figure 2C:
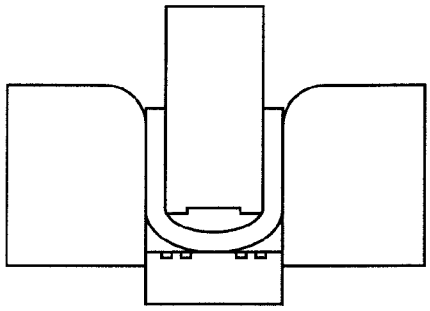

Next, FIG. 2C is the cross-sectional view illustrating the state at the time when the punch 2 is caused to descend further and the bending is advanced. As illustrated in FIG. 2C, as the punch 2 is pushed down, a gap is generated between the work W and an undersurface of the punch 2. This gap becomes larger as closer to the center portion of the work W, which is illustrated in FIG. 2C. As is apparent from FIG. 3B, the work W keeps the state of cambering in the bending ridge line direction at this time. However, as described above, the amount of camber of the work W in the bending ridge line direction is reduced considerably compared with the case of FIG. 9B. In the state of FIG. 2C, the work W and the knock out die 3 are brought into contact with each other only in the vicinity of a portion which is the center portion in cross-section of FIG. 2C and also is the center portion of the work W in the bending ridge line direction.

Figure 2D:
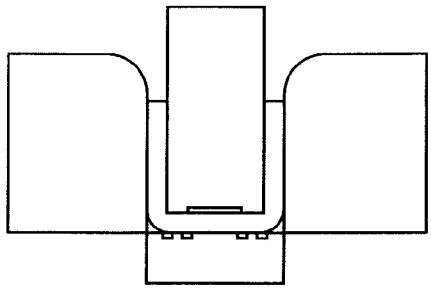

Next, FIG. 2D is the cross-sectional view illustrating the state at the time when the punch 2 is caused to descend further, and the bending is advanced and then finished. When the state shifts from FIG. 2C to FIG. 2D, the contact between the work W and the knock out die 3 is gradually expanded from the center portion of the cross-section of FIG. 2C toward the bending ridge line direction. At the same time, the contact therebetween is also gradually expanded from the center portion to the side portions of the work W in the bending ridge line direction. Specifically, the flowing-in of the material due to bending deformation is advanced in such a manner that the flowing-in amount Vc at the center portion of the work W in the ridge line direction, in which deformation is started earlier, becomes large to some extent, and then the side portions of the work W in the ridge line direction are deformed behind the deformation occurring at the center portion by an amount in which the work W cambers in the Y direction, whereby the flowing-in amount Vs starts to increase. In other words, at the time when the bending is finished, excessive stresses are generated as closer to the side portions of the work W in the ridge line direction. However, the amount of camber of the work W in the bending ridge line direction of FIG. 2C is much smaller compared with that of FIG. 9C. In addition, the grooves 3*a* provided in the knock out die 3 reduce the friction between the work W and the knock out die 3 at the side portions thereof in the bending ridge line direction, with the result that the stresses applied on the side portions thereof in the bending ridge line direction are considerably reduced. As a result, it is possible to reduce the above-mentioned camber and undulation of the work W in the direction indicated by the arrow A of the FIG. 11B by a large amount.

Further, in Example 1 of the present invention, the widths of the grooves 3*a* of the knock out die 3 become continuously larger from the center portion toward the side portions of the work W in the bending ridge line direction. For this reason, a distribution of frictional force over the entire surface of the work W, which is brought into contact with the knock out die 3, can be continuously controlled. Accordingly, unnecessary frictional force applied to the work W can be reduced, which reduces a partial deformation amount of the work W at each time during the bending. In this manner, temporal deformation behaviors of the entire work W during the bending are precisely controlled, with the result that the camber and undulation of the work W can be effectively reduced.

EXPERIMENT 1

Figure 3A:
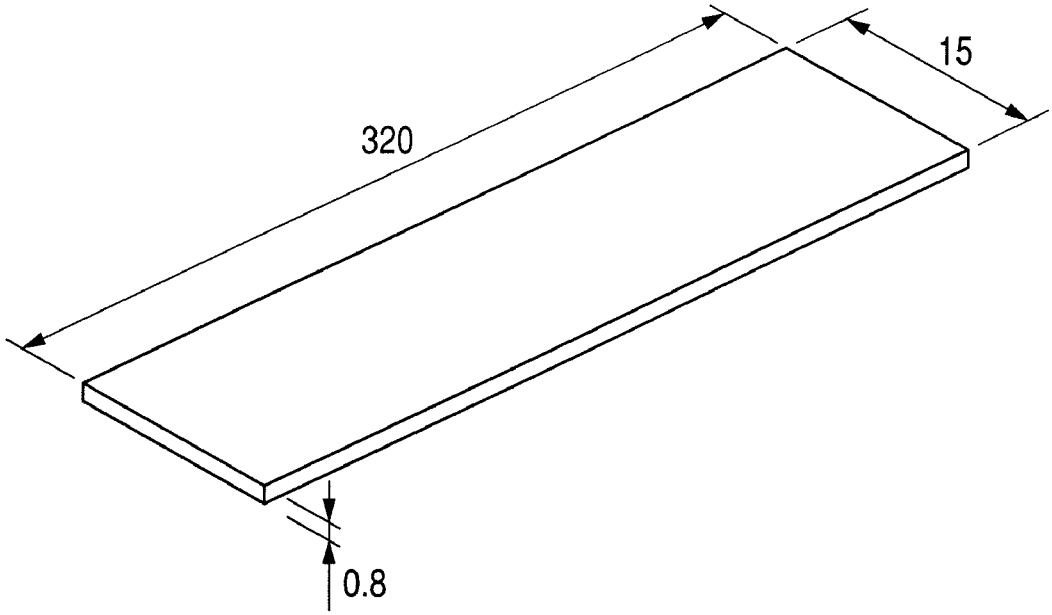
FIGS. 3A and 3B illustrate a work before bending and the work after the bending according to Example 1, respectively.

The bending was performed on the work W illustrated in FIG. 3A which has a length of 15 mm, a width of 320 mm, and a thickness of 0.8 mm by employing the method as illustrated in FIGS. 2A to 2D with the use of the die illustrated in FIG. 1A. The work W after the bending has an outside dimension in which a bending height is 5.15 mm, the length is 320 mm, and the width is 5.15 mm, as illustrated in FIG. 3B.

Figure 3B:
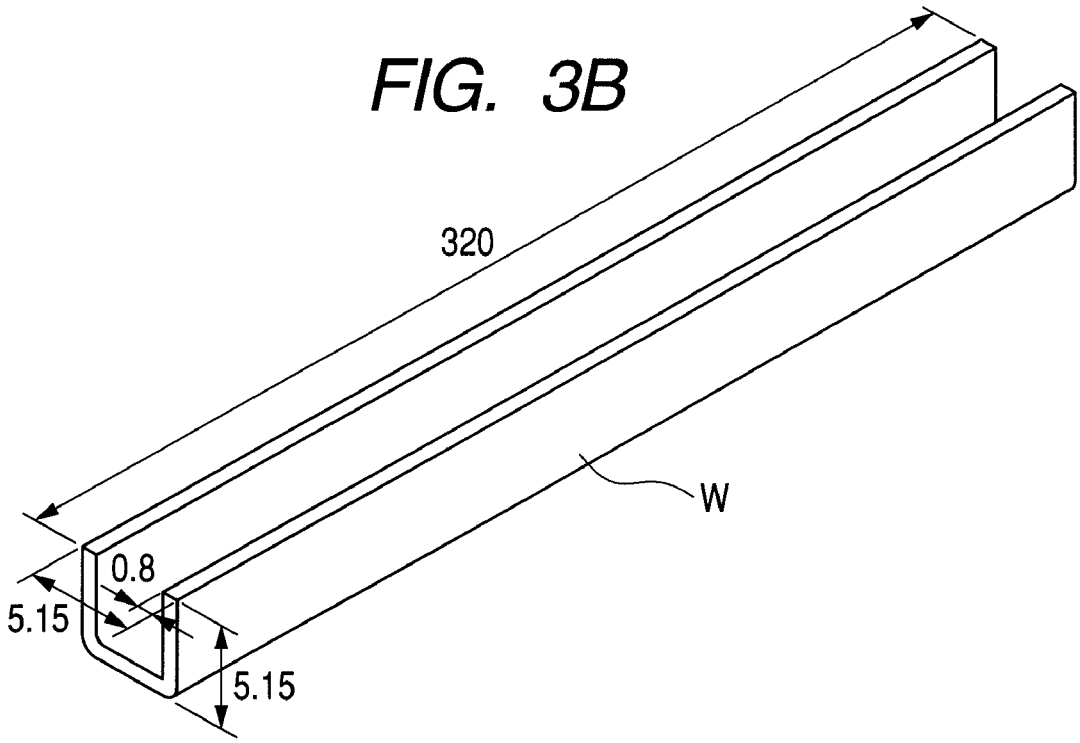
Figure 4A:
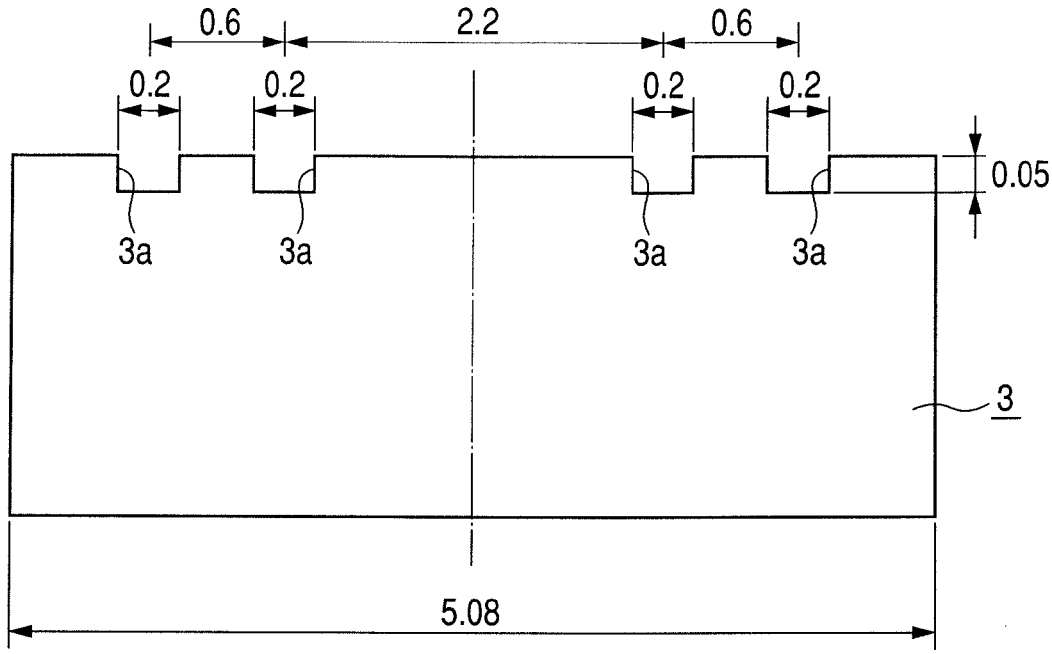
FIGS. 4A and 4B are cross-sectional views each illustrating a shape of a knock out die according to Example 1.
Figure 4B:
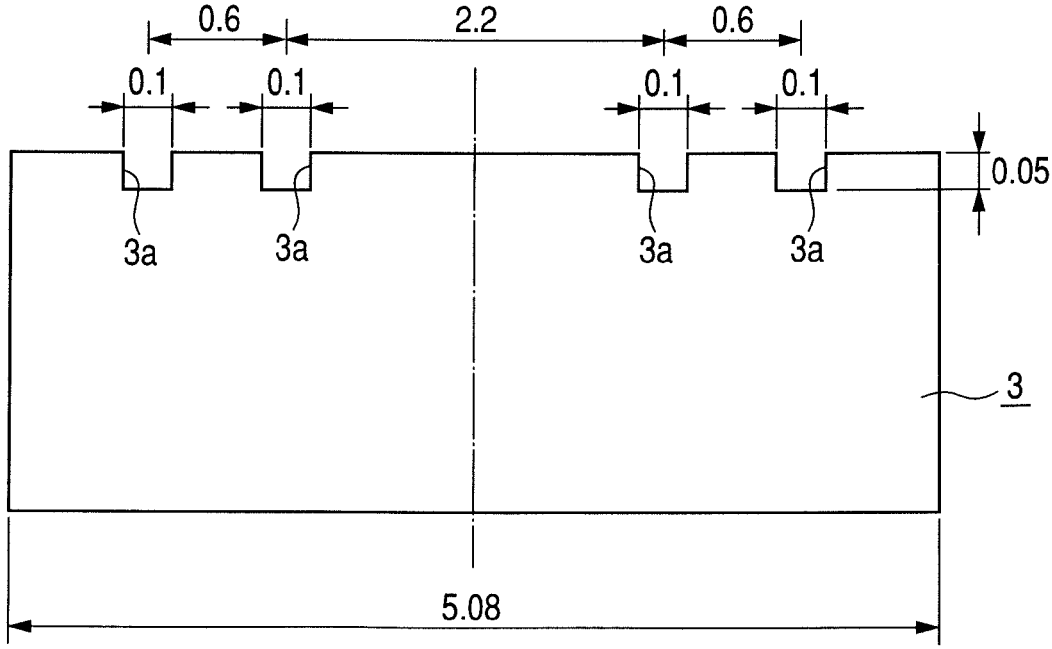

FIGS. 4A and 4B are cross-sectional views of the knock out die when the work illustrated in FIGS. 3A and 3B is processed. The knock out die 3 includes four grooves 3*a* formed therein. FIG. 4A is the cross-sectional view taken along the line 4A-4A of FIG. 1B. FIG. 4A illustrates a portion corresponding to the side portion of the work W in the bending ridge line direction. FIG. 4B is the cross-sectional view taken along the line 4B-4B of FIG. 1B. FIG. 4B illustrates a portion corresponding to the center portion of the work W in the bending ridge line direction.

In FIG. 4A, a width and a depth of the groove 3*a* are 0.2 mm and 0.05 mm, respectively, an interval between the centers of two grooves 3*a* which are located on an inner side of the knock out die 3 is 2.2 mm, and an interval between the center of the groove 3*a* located on an outer side of the knock out die 3 and the center of the groove 3*a* located on the inner side of the knock out die 3 is 0.6 mm. Further, in FIG. 4B, the width and the depth of the groove 3*a* are 0.1 mm and 0.05 mm, respectively, an interval between the centers of two grooves 3*a* which are located on the inner side of the knock out die 3 is 2.2 mm, and an interval between the center of the groove 3*a* located on the outer side of the knock out die 3 and the center of the groove 3*a* located on the inner side of the knock out die 3 is 0.6 mm. A length of the knock out die 3 is 340 mm. Processing conditions were set such that an initial pressure and a final pressure of the knock out die 3, and punch movement speed (processing speed) were 121.5 kgf, 264 kgf, and 30 mm/sec, respectively.

Figure 5:
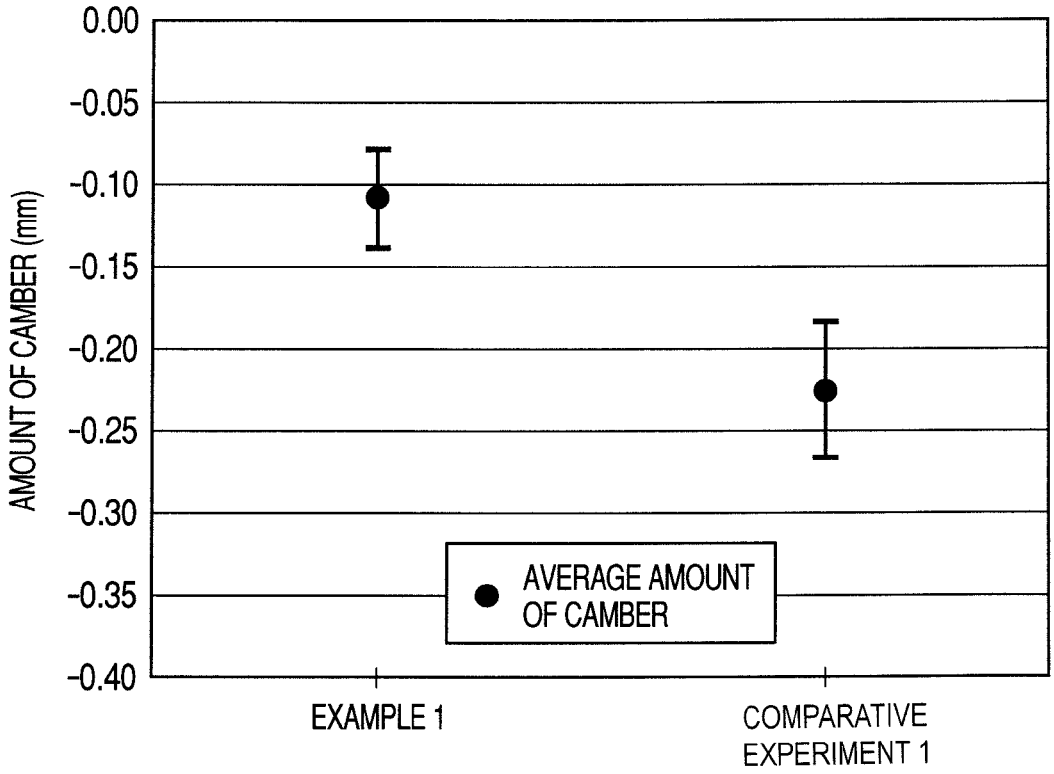
FIG. 5 is a graph illustrating amounts of camber of the work according to Example 1 and Comparative Example 1.

After the bending performed under the above-mentioned conditions, the amount of camber of the work W in the ridge line direction was measured. The number of samples to be processed was fifteen, and an average amount of camber and its variations were illustrated in FIG. 5. As can be seen from FIG. 5, in Experiment 1, the average amount of camber of the work W was about 0.11 mm, and its variations were about ±0.03 mm. The average amount of camber of the work W and its variations were about a half those of Comparative Example 1 described later, which indicates that there have been made significant improvements.

Figure 6A:
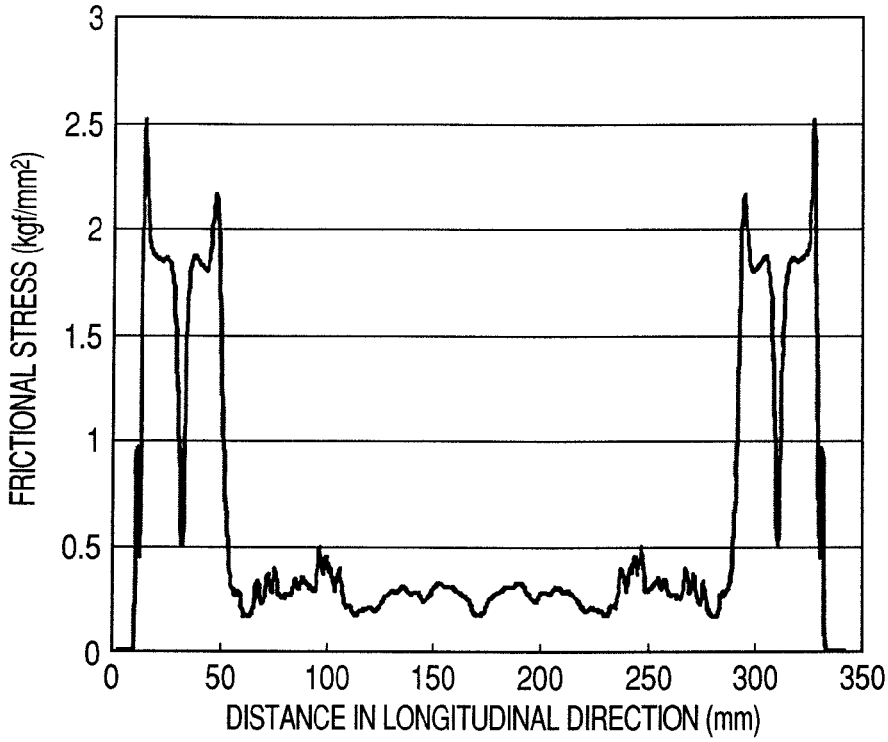
FIGS. 6A and 6B are graphs illustrating frictional stresses of the work according to Example 1 and Comparative Example 1.

Further, in Experiment 1, a frictional stress applied on the knock out die 3 was analyzed by using commercially-available simulation software based on a dynamic explicit method. FIG. 6A is a graph illustrating a distribution of frictional stresses of the work W in the bending ridge line direction in the state of FIG. 2C, which most affects a reduction of camber in the present invention. As to a distance in a longitudinal direction, which is represented by a horizontal axis in FIG. 6A, 0 mm and 350 mm represent the both side portions of the work W in the ridge line direction. It is desirable that the distribution of the frictional stresses be as flat as possible. That is, when the distribution is flat, there can be seen no distribution in the bending ridge line direction, whereby the flowing-in amount of the material becomes constant irrespective of a position of the work W in the bending ridge line direction. In the case of this experiment, the state of FIG. 2C indicates the time when the knock out die 3 was located above its lowest point by 0.5 mm.

As can be seen from FIG. 6A, the distribution of the frictional stresses in portions of the work W 50 mm or more away from the both side portions thereof shows nearly a constant value. In other words, the flowing-in amounts of the material in the portions of the work W 50 mm or more away from the both side portions thereof W are nearly constant, which indicates that bending is performed under nearly the same conditions. It should be noted that the frictional stresses in the portions of the work W within less than 50 mm from the both side portions thereof shows a high value. However, as described above, the deformation amounts of the both side portions of the work W are small when the state shifts from FIG. 2C to FIG. 2D. Accordingly, as can be seen also from FIG. 6A, there are extremely little effect on the camber and undulation of the work W.

COMPARATIVE EXPERIMENT 1

The bending was performed on the same work as that of Experiment 1 by using the above-mentioned bending apparatus illustrated in FIGS. 9A to 9D under the same conditions as those of Experiment 1. In other words, grooves or the like are not processed on the knock out die 103.

As in the case of Experiment 1, the amount of camber of the work W in the ridge line direction was measured. Contact type three-dimensional measuring apparatus was used for the measurement. The number of samples to be processed was fifteen, and the average amount of camber and its variations were illustrated in FIG. 5. As can be seen from FIG. 5, the average amount of camber of the work W of Comparative Experiment 1 was about 0.23 mm, and its variations were about ±0.05 mm.

Figure 6B:
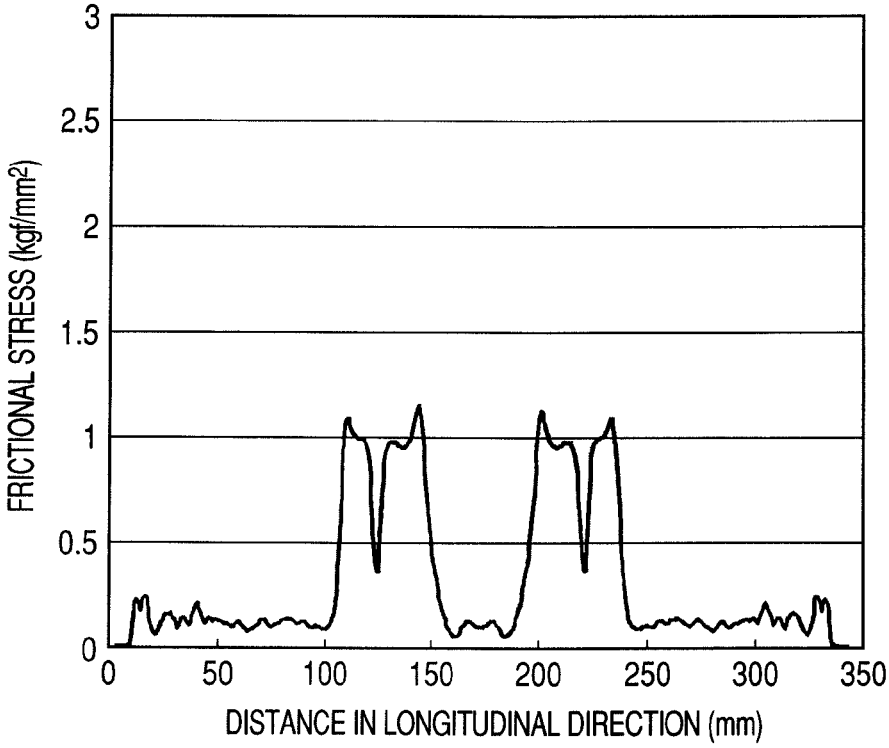

In addition, as in the case of Example 1, the frictional stress applied on the knock out die 3 was analyzed by using commercially-available simulation software based on the dynamic explicit method. FIG. 6B illustrates a distribution of the frictional stresses of the work W in the bending ridge line direction in the state of FIG. 9C.

As can be seen from FIG. 6B, frictional stresses in the portions which are 100 to 150 mm from the both side portions of the work W are remarkably larger compared with other portions. A peak value of the distribution of the frictional stresses in FIG. 6B is smaller compared with Experiment 1. However, a region in which the frictional stress is continuously constant is small, and the distribution in the bending ridge line direction of the work is large. In other words, in the case of Comparative Experiment 1, a change in frictional stress of the work in the bending ridge line direction is large, which causes the camber or undulation of the work as can be seen from FIG. 6B.

Figure 7A:
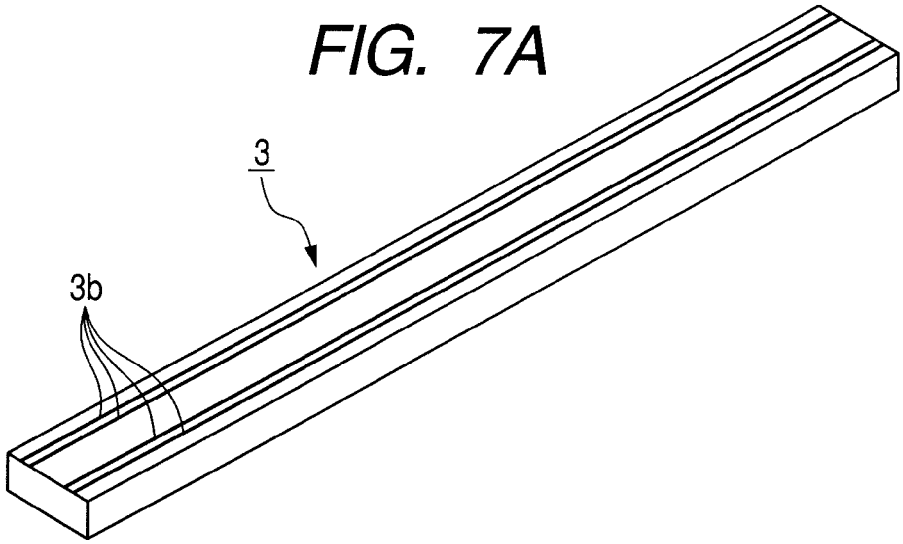
FIGS. 7A, 7B and 7C are perspective views illustrating a work according to Example 1 of another embodiment.
Figure 7B:
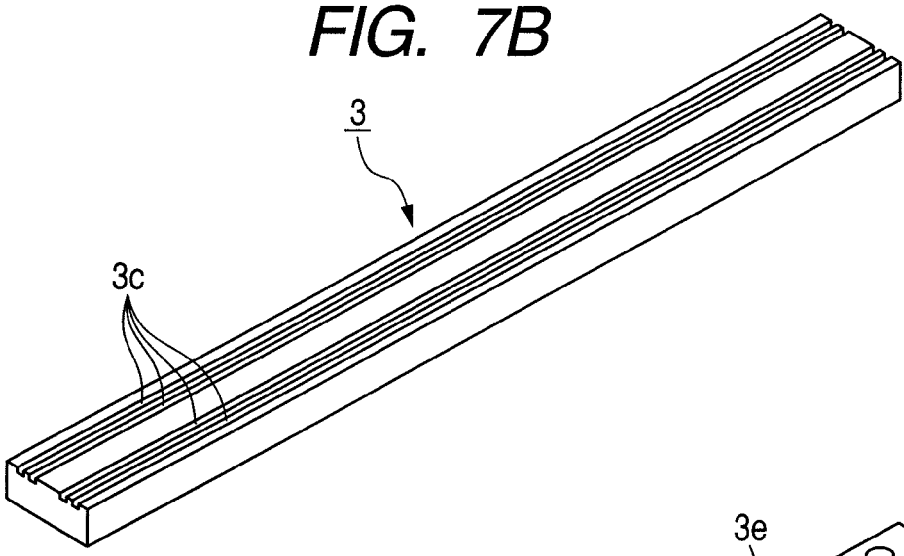
Figure 7C:
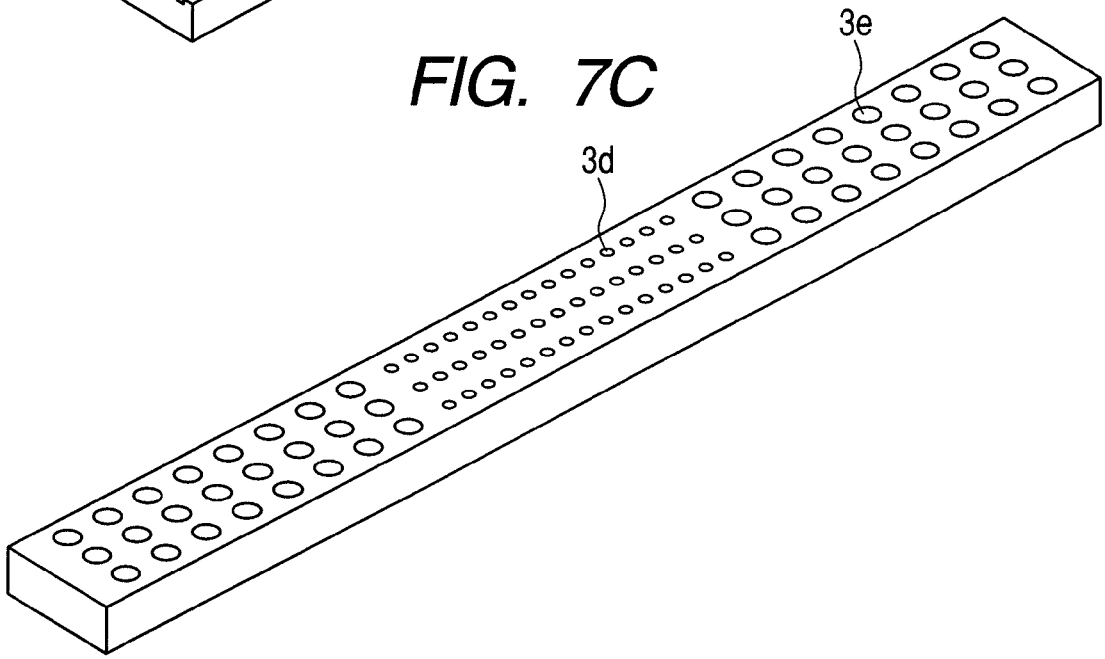

It should be noted that, in the present invention, the distribution of the friction on the surface of the knock out die 3 is intended to be small at the center portion thereof and large at the side portions thereof in the bending ridge line direction. Accordingly, instead of providing the grooves 3*a*, multiple groove-like hole rows each formed of multiple holes 3*b* may be formed on the surface of the knock out die 3, as illustrated in FIG. 7A. Hole rows arranged in parallel to the bending ridge line may be provided so that widths of the hole rows at the side portions of the knock out die 3 in the bending ridge line direction are larger than a width of the hole row at the center portion thereof. Further, the width of the hole row may be continuously or gradually changed. Alternatively, as illustrated in FIG. 7B, there may be provided friction-reduced regions 3*c* which are partially provided in parallel to the bending ridge line and are formed through surface treatment or made of a different kind of metal material, and their widths are changed, with the result that friction may be changed in a direction parallel to the bending ridge line. Further alternatively, without being limited to groove-like holes, and as illustrated in FIG. 7C, holes 3*d* each having a small diameter and holes 3*e* each having a large diameter may be provided at the center portion and at the side portions of the knock out die 3 in the bending ridge line direction, respectively. Further, when surface roughness is simply made large at the center portion and small at the side portions on the surface of the knock out die 3 in the bending ridge line direction, there can be obtained effects as described above.

EXAMPLE 2

Figure 8A:
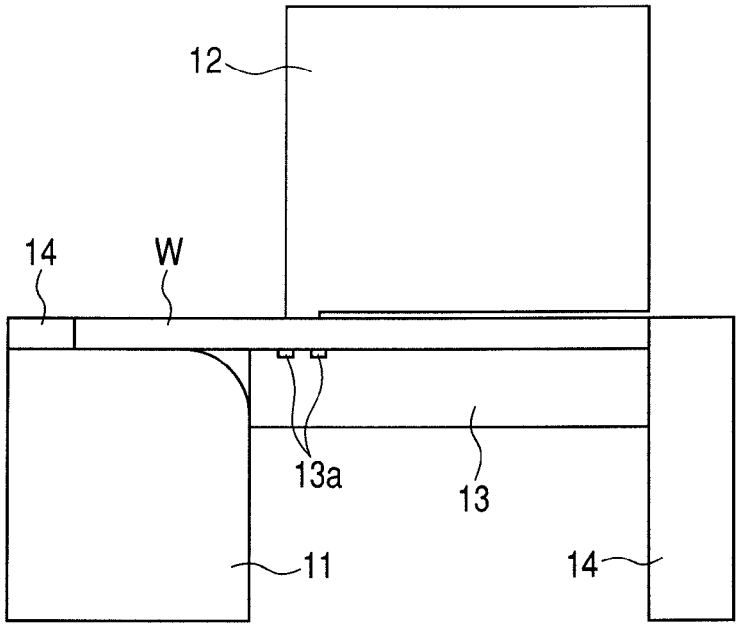
FIGS. 8A, 8B and 8C are a cross sectional view illustrating a bending apparatus, a perspective view illustrating a knock out die, and a perspective view illustrating a work subjected to bending according to Example 2 of the present invention, respectively.
Figure 8B:
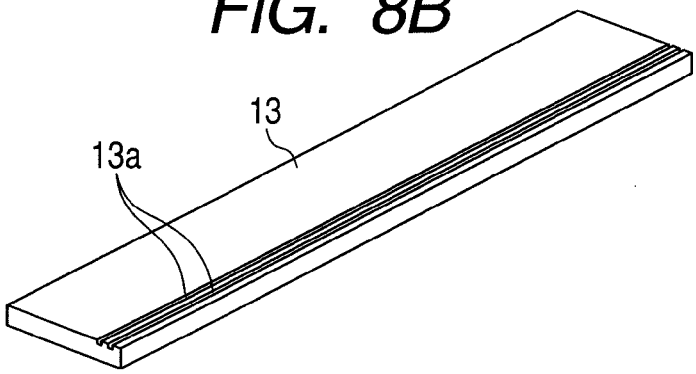
Figure 8C:
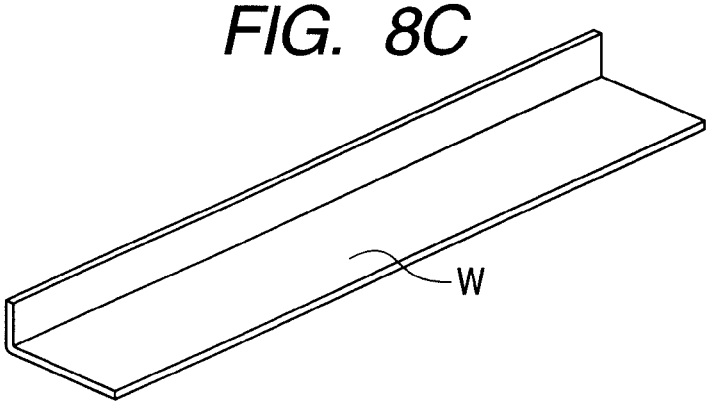

The example of both-side bending in which the both sides of the work W are bent has been described in Example 1. However, similar effects can be achieved also in the case of one-side bending in which only one side portion of the work W is bent, as shown in FIGS. 8A to 8C. FIG. 8A is a cross-sectional view illustrating a state of the bending apparatus before the bending is started. In FIG. 8A, the bending apparatus includes a sheet metal member (work) W to be subjected to bending, a die 11, a punch 12, a knock out die 13, and a back-up heel 14. The work W is placed on the die 11 so as to be cantilevered. The knock out die 13 is placed between the die 11 and the back-up heel 14 below the work W, and the punch 12 is placed at a position so as to be opposed to the knock out die 13 through the work W. The knock out die 13 is a member serving as a bracket when the work W is pressurized by the punch 12, and is pressed against the work W by a spring member (not shown) from below. As the punch 12 descends and the work W is bent, the spring member contracts, whereby the knock out die 13 descends.

FIG. 8B is a perspective view illustrating the knock out die 13. On a surface of the knock out die 13, which is to be brought into contact with the work W, there are formed multiple grooves 13*a* serving as a friction-reduced region which extends along the bending ridge line for reducing friction between the work W and the knock out die 13. In this case, two grooves 13*a* are formed, and a width of each thereof becomes gradually narrower from the side portions toward the center portion of the knock out die 13. FIG. 8C illustrates the work W which is formed in this embodiment. The work W is bent into an L-shape.

According to the present invention, friction generated at the side portions on the surface of the knock out die in the direction parallel to the bending ridge line is made larger than friction generated at the center portion thereof, and thus an internal stress of the work during the bending can be controlled, and the camber due to a residual stress of the work can be reduced. Moreover, there is no need to employ a complicated apparatus, and hence a bending apparatus with high reliability can be provided at extremely low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-094535, filed Apr. 1, 2008, and Japanese Patent Application No. 2009-020246, filed Jan. 30, 2009, which are hereby incorporated by reference herein in their entirety.

What is claimed is:

1. A bending apparatus for bending a metal member, comprising:

at least one die;

a punch disposed on a side opposed to a side of the at least one die through the metal member, for pressurizing the metal member by relatively moving with respect to the at least one die to perform bending;

a knock out die for supporting the metal member when the bending is performed, wherein friction generated on a surface of the knock out die for receiving the metal member becomes smaller continuously or gradually from a center portion toward side portions thereof in a bending ridge line direction;

the surface of the knock out die includes multiple grooves formed at the side portions thereof in the bending ridge line direction; and widths of the multiple grooves become larger continuously or gradually from the center portion toward the side portions of the knock out die in the bending ridge line direction.

2. The bending apparatus according to claim 1, wherein one die is disposed below the metal member, and the punch performs bending to form a metal member with a generally L-shaped cross-section.

3. The bending apparatus according to claim 1, wherein a first die and a second die are disposed below the metal member, and the punch performs bending to form a metal member with a generally U-shaped cross-section.

4. A bending apparatus for bending a metal member, comprising:

at least one die;

a punch disposed on a side opposed to a side of the at least one die through the metal member, for pressurizing the metal member by relatively moving with respect to the at least one die to perform bending;

a knock out die for supporting the metal member when the bending is performed, wherein friction generated on a surface of the knock out die for receiving the metal member becomes smaller continuously or gradually from a center portion toward side portions thereof in a bending ridge line direction;

the surface of the knock out die includes multiple hole rows each including multiple holes formed at the side portions thereof in the bending ridge line direction; and widths of the multiple hole rows become larger continuously or gradually from the center portion toward the side portions of the knock out die in the bending ridge line direction.

5. The bending apparatus according to claim 4, wherein one die is disposed below the metal member, and the punch performs bending to form a metal member with a generally L-shaped cross-section.

6. The bending apparatus according to claim 4, wherein a first die and a second die are disposed below the metal member, and the punch performs bending to form a metal member with a generally U-shaped cross-section.

7. A bending apparatus for bending a metal member, comprising:

at least one die;

a punch disposed on a side opposed to a side of the at least one die through the metal member, for pressurizing the metal member by relatively moving with respect to the at least one die to perform bending;

a knock out die for supporting the metal member when the bending is performed, wherein friction generated on a surface of the knock out die for receiving the metal member becomes smaller continuously or gradually from a center portion toward side portions thereof in a bending ridge line direction;

the surface of the knock out die includes multiple holes formed uniformly thereon; and diameters of the multiple holes become larger continuously or gradually from the center portion toward the side portions of the knock out die in the bending ridge line direction.

8. The bending apparatus according to claim 7, wherein one die is disposed below the metal member, and the punch performs bending to form a metal member with a generally L-shaped cross-section.

9. The bending apparatus according to claim 7, wherein a first die and a second die are disposed below the metal member, and the punch performs bending to form a metal member with a generally U-shaped cross-section.

10. A bending method of bending a metal member, comprising the steps of:

disposing a metal member on at least one die; and pressurizing the metal member with a punch to perform bending; and providing a knock out die for supporting the metal member, wherein, when the bending is performed, friction generated on a surface of the knock out die becomes smaller continuously or gradually from a center portion toward side portions thereof in a bending ridge line direction, the surface of the knock out die includes multiple grooves formed at the side portions thereof in the bending ridge line direction; and widths of the multiple grooves become larger continuously or gradually from the center portion toward the side portions of the knock out die in the bending ridge line direction.

11. The bending method according to claim 10, wherein the metal member is disposed on one die, and the bending step forms a metal member with a generally L-shaped cross-section.

12. The bending method according to claim 10, wherein the metal member is disposed on a first die and a second die, and the bending step forms a metal member with a generally U-shaped cross-section.

13. A bending method of bending a metal member, comprising the steps of:

disposing a metal member on at least one die;

pressurizing the metal member with a punch to perform bending; and providing a knock out die for supporting the metal member, wherein, when the bending is performed, friction generated on a surface of the knock out die becomes smaller continuously or gradually from a center portion toward side portions thereof in a bending ridge line direction, the surface of the knock out die includes multiple hole rows each including multiple holes formed at the side portions thereof in the bending ridge line direction; and widths of the multiple hole rows become larger continuously or gradually from the center portion toward the side portions of the knock out die in the bending ridge line direction.

14. The bending method according to claim 13, wherein the metal member is disposed on a first die and a second die, and the bending step forms a metal member with a generally U-shaped cross-section.

15. The bending method according to claim 13, wherein the metal member is disposed on one die, and the bending step forms a metal member with a generally L-shaped cross-section.

16. A bending method of bending a metal member, comprising the steps of:

disposing a metal member on at least one die;

pressurizing the metal member with a punch to perform bending; and providing a knock out die for supporting the metal member, wherein, when the bending is performed, friction generated on a surface of the knock out die becomes smaller continuously or gradually from a center portion toward side portions thereof in a bending ridge line direction, the surface of the knock out die includes multiple holes formed uniformly thereon; and diameters of the multiple holes become larger continuously or gradually from the center portion toward the side portions of the knock out die in the bending ridge line direction.

17. The bending method according to claim 16, wherein the metal member is disposed on one die, and the bending step forms a metal member with a generally L-shaped cross-section.

18. The bending method according to claim 16, wherein the metal member is disposed on a first die and a second die, and the bending step forms a metal member with a generally U-shaped cross-section.

* * * * *